US009698541B2

(12) United States Patent
Tsai et al.

(10) Patent No.: US 9,698,541 B2
(45) Date of Patent: Jul. 4, 2017

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Ya-Fen Kao, New Taipei (TW); Rui Su, New Taipei (TW); Long-Fei Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/148,713

(22) Filed: May 6, 2016

(65) Prior Publication Data

US 2016/0329645 A1 Nov. 10, 2016

(30) Foreign Application Priority Data

May 7, 2015 (CN) ..... 2015 1 0228676

(51) Int. Cl.

| | |
|---|---|
| ***H01R 9/03*** | (2006.01) |
| ***H01R 13/6595*** | (2011.01) |
| ***H01R 13/6585*** | (2011.01) |
| *H01R 13/516* | (2006.01) |
| *H01R 12/72* | (2011.01) |

(52) U.S. Cl.

CPC ..... *H01R 13/6595* (2013.01); *H01R 13/6585* (2013.01); *H01R 12/722* (2013.01); *H01R 13/516* (2013.01)

(58) Field of Classification Search

CPC ..... H01R 13/6595

USPC ..... 439/607.55, 660

See application file for complete search history.

(56) References Cited

U.S. PATENT DOCUMENTS

| | | | | |
|---|---|---|---|---|
| 4,653,836 A * | 3/1987 | Peele | ..... | H01R 13/65802 439/465 |
| 6,200,165 B1 * | 3/2001 | Simmel | ..... | H01R 13/65802 439/607.23 |
| 6,210,228 B1 * | 4/2001 | Simmel | ..... | H01R 13/65802 439/607.23 |
| 6,217,378 B1 * | 4/2001 | Wu | ..... | H01R 23/6873 439/567 |
| 7,862,346 B1 * | 1/2011 | Wan | ..... | H01R 12/712 439/607.04 |
| 8,052,467 B1 * | 11/2011 | Xie | ..... | H01R 13/5219 439/589 |

(Continued)

*Primary Examiner* — Tulsidas C Patel
*Assistant Examiner* — Peter G Leigh
(74) *Attorney, Agent, or Firm* — Muncy, Geissler, Olds & Lowe, P.C.

(57) ABSTRACT

An electrical receptacle connector includes a metallic shell, an insulated housing, a plurality of first receptacle terminals, a plurality of second receptacle terminals, and a rear cover plate. The insulated housing is received in the receiving cavity. The first receptacle terminals and the second receptacle terminals are respectively disposed at an upper portion and a lower portion of the insulated housing. The rear cover plate includes a baffle plate and a connecting portion formed at one of two sides of the baffle plate and connected to the rear of the metallic shell. The rear cover plate is closeable and openable, so that the soldering condition between the first receptacle terminals and contacts of a circuit board can be checked when the rear cover plate is opened.

10 Claims, 12 Drawing Sheets

(56) References Cited

U.S. PATENT DOCUMENTS

| | | | | |
|---|---|---|---|---|
| 8,398,438 | B2 * | 3/2013 | Zhang | H01R 13/6471 439/660 |
| 9,490,594 | B2 * | 11/2016 | Little | H01R 24/60 |
| 9,496,653 | B2 * | 11/2016 | Little | H01R 13/6582 |
| 2005/0181670 | A1 * | 8/2005 | Kumamoto | H01R 13/6275 439/358 |
| 2005/0186843 | A1 * | 8/2005 | Tsai | H01R 23/6873 439/607.36 |
| 2009/0042450 | A1 * | 2/2009 | Zheng | H01R 23/6873 439/660 |
| 2013/0059472 | A1 * | 3/2013 | Saito | H01R 13/648 439/607.27 |
| 2015/0171574 | A1 * | 6/2015 | Little | H01R 24/60 439/78 |
| 2015/0194768 | A1 * | 7/2015 | Little | H01R 13/6594 439/607.37 |
| 2015/0200504 | A1 * | 7/2015 | Little | H01R 24/60 439/345 |
| 2015/0207280 | A1 * | 7/2015 | Little | H01R 24/60 439/607.34 |
| 2015/0222059 | A1 * | 8/2015 | Little | H01R 13/6587 439/607.55 |
| 2015/0229077 | A1 * | 8/2015 | Little | H01R 12/724 439/78 |
| 2015/0244111 | A1 * | 8/2015 | Ju | H01R 13/6585 439/607.05 |
| 2015/0270646 | A1 * | 9/2015 | Kao | H01R 13/6581 439/76.1 |
| 2015/0270661 | A1 * | 9/2015 | Kao | H01R 13/5202 439/271 |

* cited by examiner

100

100

| | | | | | | | | | | | | |
|---|---|---|---|---|---|---|---|---|---|---|---|---|
| GND | TX1+ | TX1− | VBUS | CC1 | D+ | D− | SBU1 | VBUS | RX2− | RX2+ | GND | 31 |
| GND | RX1+ | RX1− | VBUS | SBU2 | D− | D+ | CC2 | VBUS | TX2− | TX2+ | GND | 41 |

Fig. 7

ELECTRICAL RECEPTACLE CONNECTOR

CROSS-REFERENCES TO RELATED APPLICATIONS

This non-provisional application claims priority under 35 U.S.C. §119(a) on Patent Application No. 201510228676.0 filed in China, P.R.C. on May 7, 2015, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, receptacle terminals held on the plastic core, and an outer iron shell circularly enclosing the plastic core. The conventional USB type-C electrical receptacle connector further comprises a rear cover plate extending from the outer iron shell. The rear cover plate is at the rear of the connector and shields the rear of the plastic core. The rear cover plate is to shield the electromagnetic radiations generated by the receptacle terminals and to prevent noise interferences.

However, in the conventional, the rear cover plate and the outer iron shell are formed as a unitary piece. Therefore, after the electrical receptacle connector is manufactured and soldered with a circuit board, the soldering condition between the contacts of the circuit board and the legs (e.g., surface mounted technology (SMT) legs) of the receptacle terminals cannot be checked, and problems like soldering spots between adjacent contacts are merged together or some of the legs are detached from the contacts may occur. As a result, once the legs are not soldered with the contacts properly, the conventional receptacle connector has to be unsoldered followed by repeating the soldering procedure again.

SUMMARY OF THE INVENTION

Accordingly, how to improve the existing connector becomes an issue.

In view of this, an embodiment of the instant disclosure provides an electrical receptacle connector. The electrical receptacle connector comprises a metallic shell, an insulated housing, a plurality of first receptacle terminals, a plurality of second receptacle terminals, and a rear cover portion. The metallic shell comprises a shell body and a receiving cavity formed therein. The insulated housing is received in the receiving cavity. The insulated housing comprises a base portion and a tongue portion extending from one side of the base portion. The tongue portion has a first surface (i.e., upper surface) and a second surface (i.e., lower surface) opposite to the first surface. The first receptacle terminals comprise a plurality of first signal terminals, at least one power terminal, and at least one ground terminal. Each of the first receptacle terminals is held in the insulated housing and disposed at the first surface. Each of the first receptacle terminals comprises a flat contact portion, a body portion, and a tail portion. The body portion is held in the base portion and disposed at the first surface of the tongue portion. The flat contact portion is extending forward from the body portion in the rear-to-front direction and partly exposed upon the first surface of the tongue portion. The tail portion is extending backward from the body portion in the front-to-rear direction, and extending out of the base portion. The second receptacle terminals comprise a plurality of second signal terminals, at least one power terminal, and at least one ground terminal. Each of the second receptacle terminals is held in the insulated housing and disposed at the second surface. Each of the second receptacle terminals comprises a flat contact portion, a body portion, and a tail portion. The body is held in the base portion and disposed at the second surface of the tongue portion. The flat contact portion is extending forward from the body portion in the rear-to-front direction and partly exposed upon the second surface of the tongue portion. The tail portion is extending backward from the body portion in the front-to-rear direction and extending out of the base portion. The rear cover portion is at the rear of the metallic shell. The rear cover portion comprises a baffle plate and a connecting portion formed at one of two sides of the baffle plate. When the rear cover portion is at an open position, the baffle plate is rotated about the connecting portion to uncover the base portion; while when the rear cover portion is at a closed position, the baffle plate is rotated about the connecting portion to cover the base portion.

According to embodiments of the instant disclosure, the openable and closeable rear cover portion allows a user or an operator to check the soldering condition between the contacts and the tail portions of the first receptacle terminals from the opening at the rear of the connector, and the soldering procedure can be redone when soldering spots are not applied to the contacts and the tail portions properly. After the contacts are firmly soldered with the tail portions of the first receptacle terminals, the rear cover portion can be covered on the rear of the receiving cavity, and the connector can be manufactured. In addition, the rear cover portion may be pivoted about the rear of the metallic shell closed, so that the rear cover opening can be opened or closed conveniently.

Furthermore, the rear cover portion further comprises a plurality of protruded blocks. When the rear cover portion covers the rear of the metallic shell, the protruded blocks may be leaned against the surface of the circuit board. Therefore, the rear cover portion can be opened again because the protruded blocks are not soldered with the circuit board; Alternatively, when the rear cover portion covers the rear of the metallic shell, the protruded blocks may be respectively in contact with and soldered with contacts of the circuit board, which means is only allowed to be opened and closed once.

Moreover, when the rear cover portion covers the rear of the metallic shell, the distance between the tail portions of the first receptacle terminals and the surface of the other side of the baffle plate (i.e., the surface of the bottom of the baffle plate is less than or equal to 0.2 mm. Therefore, the electromagnetic radiation generated by the tail portions of the first receptacle terminals can be shielded by the rear cover portion efficiently. In addition, the metallic shell and the circuit board are grounded, so that the electromagnetic interference (EMI) or radiofrequency interference (RFI) can be retarded properly. In other words, the covering of the rear cover portion allows the exposed area of the tail portions of the first receptacle terminals to be reduced, and the rear cover portion can provide a shielding function and prevent the connector from the signal interference problem.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 7 illustrates a schematic configuration diagram of the receptacle terminals of the electrical receptacle connector shown in FIG. 6;

DETAILED DESCRIPTION

Figure 1:
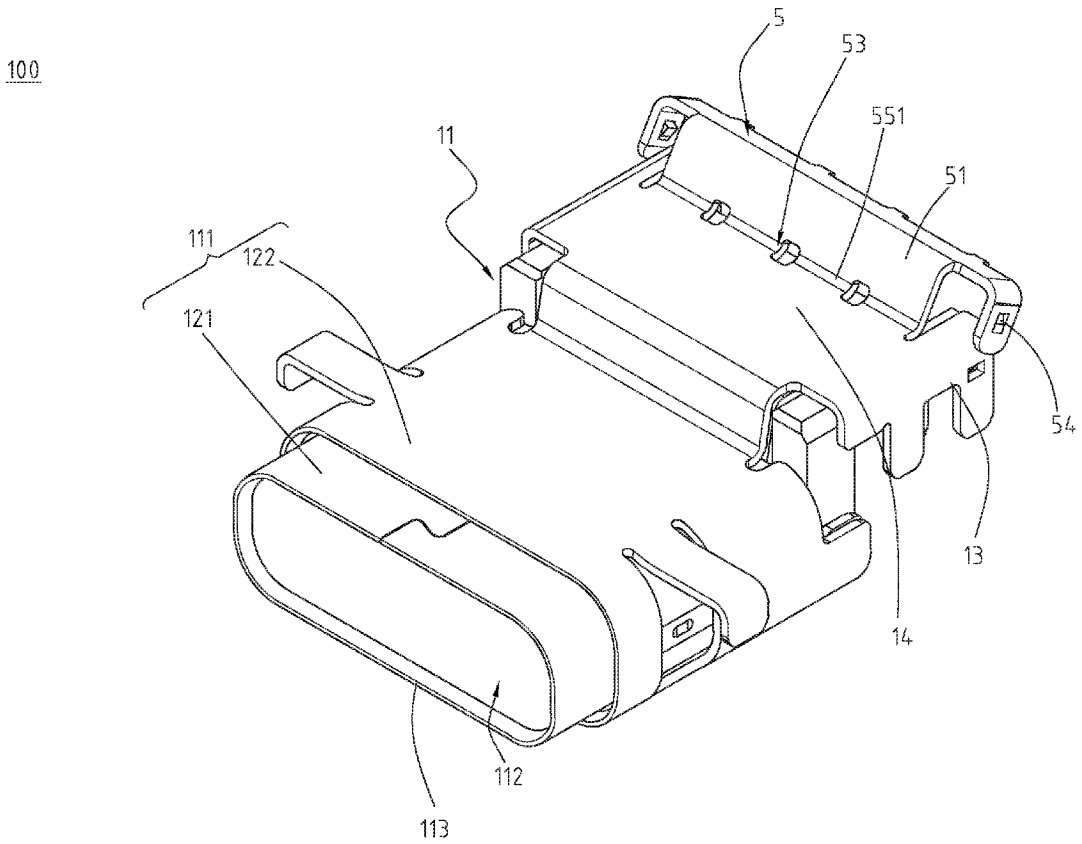
FIG. 1 illustrates a perspective view of an electrical receptacle connector according to a first embodiment of the instant disclosure.
Figure 2:
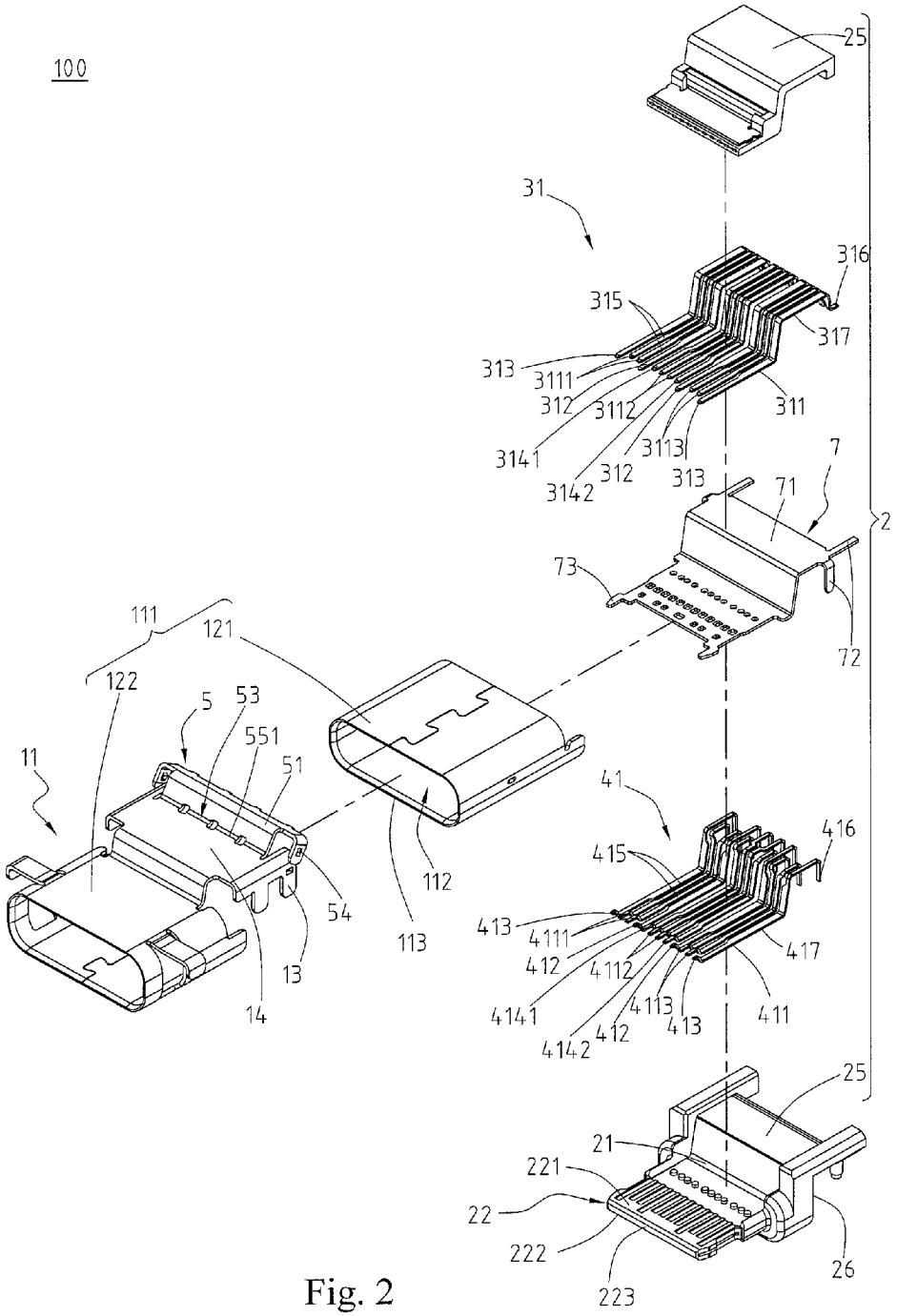
FIG. 2 illustrates an exploded view (1) of the electrical receptacle connector of the first embodiment.
Figure 3:
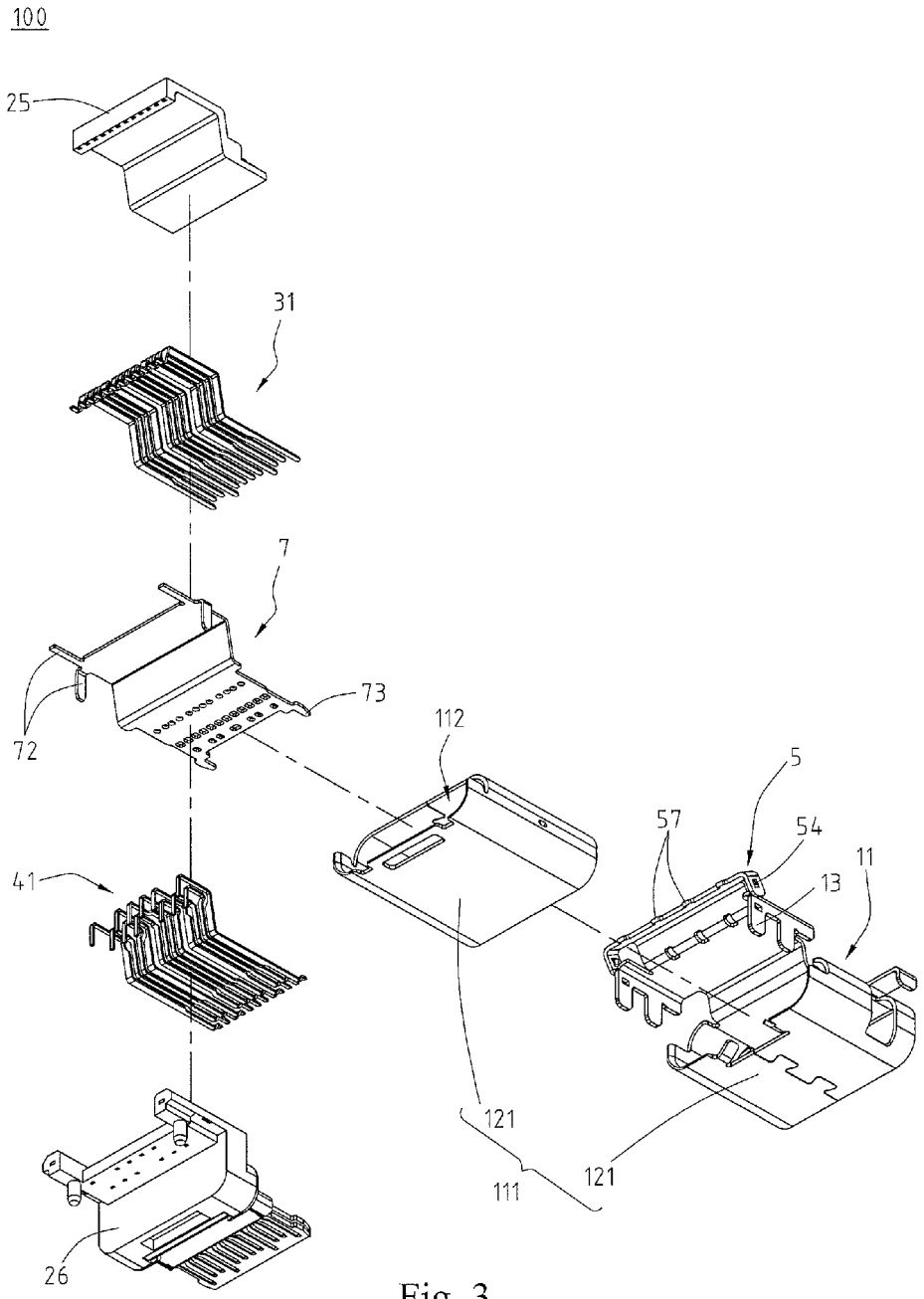
FIG. 3 illustrates an exploded view (2) of the electrical receptacle connector of the first embodiment.
Figure 4:
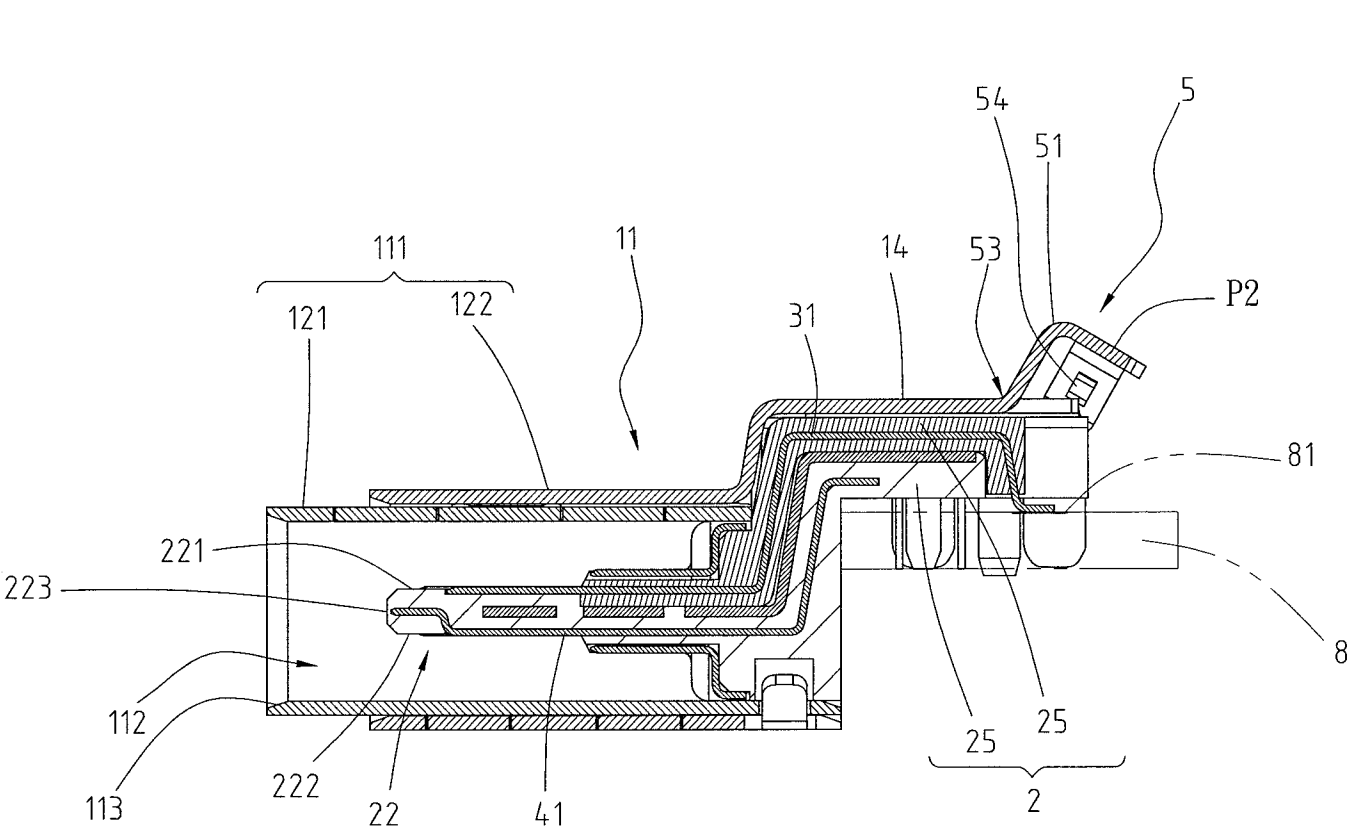
FIG. 4 illustrates a lateral sectional view of the electrical receptacle connector with a rear cover portion opened of the first embodiment.
Figure 12:
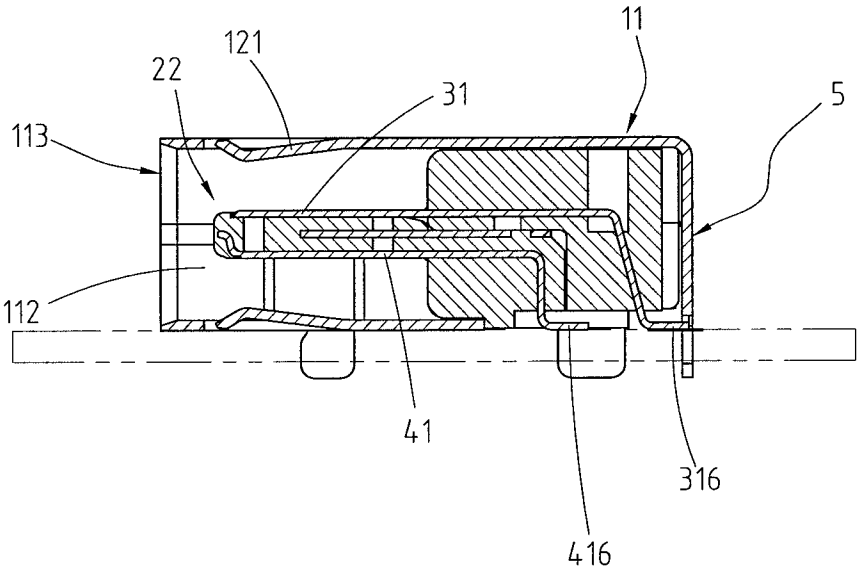
FIG. 12 illustrates a schematic lateral sectional view of another embodiment of the electrical receptacle connector soldered with a circuit board.

Please refer to FIGS. 1 to 4, which illustrate an electrical receptacle connector 100 of a first embodiment of the instant disclosure. FIG. 1 illustrates a perspective view of an electrical receptacle connector 100. FIG. 2 illustrates an exploded view (1) of the electrical receptacle connector 100. FIG. 3 illustrates an exploded view (2) of the electrical receptacle connector 100. FIG. 4 illustrates a lateral sectional view of the electrical receptacle connector 100 with a rear cover portion 5 opened. In this embodiment, the electrical receptacle connector 100 is assembled with a circuit board 8 by sinking technique. That is, one side of the circuit board 8 is cut to form a crack, and the electrical receptacle connector 100 is positioned at the crack and extending toward the side portion of the circuit board 8, but embodiments are not limited thereto. In some embodiments, the electrical receptacle connector 100 may be directly soldered on the surface of the circuit board 8, as shown in FIG. 12. In other words, in such embodiment, the circuit board 8 does not have the crack for receiving the electrical receptacle connector 100, and the electrical receptacle connector 100 can be freely assembled on and electrically connected to any portion of the surface of the circuit board 8 without altering the structure of the components inside the connector. In this embodiment, the electrical receptacle connector 100 can provide a reversible or dual orientation USB Type-C connector interface and pin assignments, i.e., a USB Type-C receptacle connector. In this embodiment, the electrical receptacle connector 100 comprises a metallic shell 11, an insulated housing 2, a plurality of first receptacle terminals 31, a plurality of second receptacle terminals 41, and the rear cover portion 5.

The metallic shell 11 is a hollowed shell, and the metallic shell 11 comprises a shell body 111 and a receiving cavity 112 formed in the shell body 111. In this embodiment, the shell body 111 is a tubular structure and defines the receiving cavity 112 therein. While in some embodiments, the metallic shell 11 may be formed by a multi-piece member. In such embodiment, the shell body 11 is a multi-pieces structure. The shell body 111 further comprises an inner shell 121 and a case 122. The inner shell 121 is a tubular structure, and the case 122 may also be a tubular structure circularly enclosing the inner shell 121 and provided as an outer shell structure of the inner shell 121; alternatively, the case 122 may be a structure having U-shaped cross section, and the case 122 can be covered on the top and two sides of the inner shell 121 and provided as an outer shell structure of the inner shell 121. In this embodiment, the rear cover portion 5 is at the rear of the case 122, but embodiments are not limited thereto. In some embodiments, the rear cover portion 5 may be at the rear of the inner shell 121 and the case 122 is omitted, as shown in FIG. 12. In addition, an inserting opening 113 with oblong shaped is formed at one side of the metallic shell 11, and the inserting opening 113 communicates with the receiving cavity 112. In this embodiment, the metallic shell 11 further comprises a top cover 14 bent and extending upward from the rear of the shell body 111.

The insulated housing 2 is received in the receiving cavity 112 of the metallic shell 11. The insulated housing 2 comprises a base portion 21, a tongue portion 22, a rear body 25, and a soldering region 26. In this embodiment, the base portion 21 and the tongue portion 22 may be made by injection molding, and a grounding plate 7 is formed in the base portion 21 and the tongue portion 22. Moreover, the tongue portion 22 is extending from one side of the base portion 21. The tongue portion 22 has two opposite surfaces, one is a first surface 221 (i.e., the upper surface), and the other is a second surface 222 (i.e., the lower surface). In addition, the front surface 223 of the tongue portion 22 is connected the first surface 221 with the second surface 222 and is close to the insertion opening 113 In other words, the front lateral surface 223 is adjacent to the insertion opening 113 and perpendicularly connected to the first surface 221 and the second surface 222, respectively. The rear body 25 is bent and extending upward from the rear of the base portion 21 to form a stair-like structure, and the soldering region 26 is formed at the bottom of the rear body 25 to be soldered with a circuit board 8. In other words, the bottom of the rear body 25 is hollowed to form the soldering region 26, and the soldering region 26 can be assembled to the side portion of the circuit board 8. In addition, in this embodiment, the appearance of the insulated housing 2 is like a two-step stair; then a circuit board 8 can be assembled with the electrical receptacle connector 100 by sinking technique. Moreover, the top cover 14 of the metallic shell 11 covers the rear body 25.

Please refer to FIGS. 2, 4, 6, and 7. The first receptacle terminals 31 comprise a plurality of first signal terminals 311, at least one power terminal 312, and at least one ground terminal 313. Referring to FIG. 7, the first receptacle terminals 31 comprise, from left to right, a ground terminal 313 (Gnd), a first pair of first signal terminals 3111 (TX1+−, differential signal terminals), a power terminal 312 (Power/VBUS), a first function detection terminal 3141 (CC1, a terminal for inserting orientation detection of the connector and for cable recognition), a second pair of first signal terminals 3112 (D+−, differential signal terminals), a supplement terminal 3142 (SBU1, a terminal can be reserved for other purposes), another power terminal 312 (Power/VBUS), a third pair of first signal terminals 3113 (RX2+−, differential signal terminals), and another ground terminal 313 (Gnd). In this embodiment, twelve first receptacle terminals 31 are provided for transmitting USB 3.0 signals. In some embodiments, the rightmost ground terminal 313 (Gnd) (or the leftmost ground terminal 313 (Gnd)) or the first supplement terminal 3142 (SBU1) can be further omitted. Therefore, the total number of the first receptacle terminals 31 can be reduced from twelve terminals to seven terminals. Furthermore, the rightmost ground terminal 313 (Gnd) may be replaced by a power terminal 312 (Power/VBUS) and provided for power transmission. In this embodiment, the width of the power terminal 312 (Power/VBUS) may be, but not limited to, equal to the width of the first signal terminal 311. In some embodiments, the width of the power terminal 312 (Power/VBUS) may be greater than the width of the first signal terminal 311 and an electrical receptacle connector 100 having the power terminal 312 (Power/VBUS) can be provided for large current transmission.

Please refer to FIGS. 2, 4, 6, and 7. The first receptacle terminals 31 are held in the base portion 21 and the tongue portion 22. Each of the first receptacle terminals 31 comprises a flat contact portion 315, a body portion 317, and a tail portion 316. For each of the first receptacle terminals 31, the body portion 317 is held in the base portion 21 and the tongue portion 22, the flat contact portion 315 is extending forward from the body portion 317 in the rear-to-front direction and partly exposed upon the first surface 221 of the tongue portion 22, and the tail portion 316 is extending backward from the body portion 317 in the front-to-rear direction and protruded from the base portion 21. The first signal terminals 311 are disposed at the first surface 221 and transmit first signals (namely, USB 3.0 signals). The tail portions 316 are protruded from the bottom of the base portion 21. In addition, the tail portions 316 may be, but not limited to, bent horizontally to form flat legs, named SMT (surface mounted technology) legs, which can be mounted or soldered on the surface of a printed circuit board by using surface mount technology.

Please refer to FIGS. 2, 4, 6, and 7. The second receptacle terminals 41 comprise a plurality of second signal terminals 411, at least one power terminal 412, and at least one ground terminal 413. Referring to FIG. 7, the second receptacle terminals 41 comprise, from right to left, a ground terminal 413 (Gnd), a first pair of second signal terminals 4111 (TX2+−, differential signal terminals), a power terminal 412 (Power/VBUS), a second function detection terminal 4141 (CC2, a terminal for inserting orientation detection of the connector and for cable recognition), a second pair of second signal terminals 4112 (D+−, differential signal terminals), a supplement terminal 4142 (SBU2, a terminal can be reserved for other purposes), another power terminals 412 (Power/VBUS), a third pair of second signal terminals 4113 (RX1+1, differential signal terminals), and another ground terminal 413 (Gnd). In this embodiment, twelve second receptacle terminals 41 are provided for transmitting USB 3.0 signals. In some embodiments, the rightmost ground terminal 413 (or the leftmost ground terminal 413) or the second supplement terminal 4142 (SBU2) can be further omitted. Therefore, the total number of the second receptacle terminals 41 can be reduced from twelve terminals to seven terminals. Furthermore, the rightmost ground terminal 413 may be replaced by a power terminal 412 and provided for power transmission. In this embodiment, the width of the power terminal 412 (Power/VBUS) may be, but not limited to, equal to the width of the second signal terminal 411. In some embodiments, the width of the power terminal 412 (Power/VBUS) may be greater than the width of the second signal terminal 411 and an electrical receptacle connector 100 having the power terminal 412 (Power/VBUS) can be provided for large current transmission.

Please refer to FIGS. 2, 4, 6, and 7. The second receptacle terminals 41 are held in the base portion 21 and the tongue portion 22. Each of the second receptacle terminals 41 comprises a flat contact portion 415, a body portion 417, and a tail portion 416. For each of the second receptacle terminals 41, the body portion 417 is held in the base portion 21 and the tongue portion 22, the flat contact portion 415 is extending from the body portion 417 in the rear-to-front direction and partly exposed upon the second surface 222 of the tongue portion 22, and the tail portion 416 is extending backward from the body portion 417 in the front-to-rear direction and protruded from the base portion 21. The second signal terminals 411 are disposed at the second surface 222 and provided for transmitting second signals (i.e., USB 3.0 signals). The tail portions 416 are protruded from the bottom of the base portion 21. In addition, the tail portions 416 may be, but not limited to, bent horizontally to form flat legs, named SMT legs, which can be mounted or soldered on the surface of a printed circuit board by using surface mount technology. In some embodiments, the tail portions 416 are extending downwardly to form vertical legs, named through-hole legs, that are inserted into holes drilled in a printed circuit board by using through-hole technology.

Please refer to FIGS. 2, 4, 6, and 7. In this embodiment, the first receptacle terminals 31 and the second receptacle terminals 41 are respectively disposed at the first surface 221 and the second surface 222 of the tongue portion 22. Additionally, pin-assignments of the first receptacle terminals 31 and the second receptacle terminals 41 are point-symmetrical with a central point of the receiving cavity 112 as the symmetrical center. In other words, pin-assignments of the first receptacle terminals 31 and the second receptacle terminals 41 have 180 degree symmetrical design with respect to the central point of the receiving cavity 112 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 31 (or the second receptacle terminals 41), are rotated by 180 degrees with the symmetrical center as the rotating center, the first receptacle terminals 31 and the second receptacle terminals 41 are overlapped. That is, the rotated first receptacle terminals 31 are arranged at the position of the original second receptacle terminals 41, and the rotated second receptacle terminals 41 are arranged at the position of the original first receptacle terminals 31. In other words, the first receptacle terminals 31 and the second receptacle terminals 41 are arranged upside down, and the pin assignments of the flat contact portions 315 are left-right reversal with respect to that of the flat contact portions 415. An electrical plug connector is inserted into the electrical receptacle connector 100 with a first orientation where the first surface 221 is facing up, for transmitting first signals. Conversely, the electrical plug connector is inserted into the electrical receptacle connector 100 with a second orientation where the first surface 221 is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Please refer to FIGS. 2, 4, 6, and 7. In this embodiment, as viewed from the front of the receptacle terminals 31, 41, the position of the first receptacle terminals 31 corresponds to the position of the second receptacle terminals 41.

Additionally, in some embodiments, the electrical receptacle connector 100 is devoid of the first receptacle terminals 31 (or the second receptacle terminals 41) when an electrical plug connector to be mated with the electrical receptacle connector 100 has upper and lower plug terminals. In the case that the first receptacle terminals 31 are omitted, the upper plug terminals or the lower plug terminals of the electrical plug connector are in contact with the second receptacle terminals 41 of the electrical receptacle connector 100 when the electrical plug connector is inserted into the electrical receptacle connector 100 with the dual orientations. Conversely, in the case that the second receptacle terminals 41 are omitted, the upper plug terminals or the lower plug terminals of the electrical plug connector are in contact with the first receptacle terminals 31 of the electrical receptacle connector 100 when the electrical plug connector is inserted into the electrical receptacle connector 100 with the dual orientations.

Please refer to FIGS. 3 and 4. In this embodiment, the tail portions 316, 416 are protruded from the base portion 211 and arranged separately. The tail portions 316, 416 may be arranged into two parallel rows. Alternatively, the tail portions 416 may be aligned into two rows and the first row of the tail portions 416 is aligned by an offset with respect to the second row of the tail portions 416; thus, the tail portions 316, 416 form three rows.

Please refer to FIGS. 2, 4, 6, and 7. In this embodiment, the position of the first receptacle terminals 31 corresponds to the position of the second receptacle terminals 41. In other words, the position of the flat contact portions 315 correspond to the position of the flat contact portions 415, but embodiments are not limited thereto. In some embodiments, the first receptacle terminals 31 may be aligned by an offset with respect to the second receptacle terminals 41. That is, the flat contact portions 315 are aligned by an offset with respect to the flat contact portions 415. In addition, the position of the tail portions 316 may correspond to the position of the tail portion 416. Alternatively, the tail portions 316 may be aligned by an offset with respect to the tail portions 416. Accordingly, the crosstalk between the first receptacle terminals 31 and the second receptacle terminals 41 can be reduced during signal transmission because of the offset alignment of the receptacle terminals 31, 41. It is understood that, when the receptacle terminals 31, 41 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 31, 41 of the electrical receptacle connector 100 for power or signal transmission.

In the foregoing embodiments, the receptacle terminals 31, 41 are provided for transmitting USB 3.0 signals, but embodiments are not limited thereto. In some embodiments, for the first receptacle terminals 31 in accordance with transmission of USB 2.0 signals, the first pair of first signal terminals 3111 (TX1+−) and the third pair of first signal terminals 3113 (RX2+−) are omitted, and the second pair of first signal terminals 3112 (D+−) 41 and the power terminals 312 (Power/VBUS) are retained. While for the second receptacle terminals 41 in accordance with transmission of USB 2.0 signals, the first pair of second signal terminals 4111 (TX2+−) and the third pair of second signal terminals 4113 (RX1+−) are omitted, and the second pair of second signal terminals 4112 (D+−) and the power terminals 412 (Power/VBUS) are retained.

Please refer to FIGS. 2 to 5. The rear cover portion 5 is an elongate plate and is at the rear of the metallic shell 5. The rear cover portion 5 comprises a baffle plate 51 and a connecting portion 53 formed at one of two sides of the baffle plate 51 (i.e., formed at the top of the baffle plate 51). The baffle plate 51 has an approximately L-shaped cross section. In addition, the rear cover portion 5 and the metallic shell 11 may be a unitary member or separated members. In this embodiment, the rear cover portion 5 and the metallic shell 11 are formed as a unitary member. The rear cover portion 5 further comprises a plurality of protruded blocks 57 extending outward from the other side of the baffle plate 51 (i.e., extending outward from the bottom of the baffle plate 51) and spaced from each other. When the rear cover portion 5 covers the rear of the metallic shell 11 (i.e., when the rear cover portion 5 is at a closed position), the protruded blocks 57 are leaned against the surface of the circuit board 8. In such embodiment, the rear cover portion 5 can be opened (i.e., being moved to an open position) again because the protruded blocks 57 are not soldered with the circuit board 8. Alternatively, in one embodiment, when the rear cover portion 5 covers the rear of the metallic shell 11, the protruded blocks 57 are respectively in contact with and soldered with contacts of the circuit board 8, which means in such embodiment the rear cover portion 5 is allowed to be opened and closed one time. In this embodiment, the rear cover portion 5 further comprises a plurality of fixing pieces 54 at two sides of the baffle plate 51, and the metallic shell 11 further comprises a plurality of lateral plates 13 at two sides of the shell body 111. When the rear cover portion 5 covers the rear of the metallic shell 11, the fixing pieces 54 are respectively buckled with the lateral plates 13.

Figure 5:
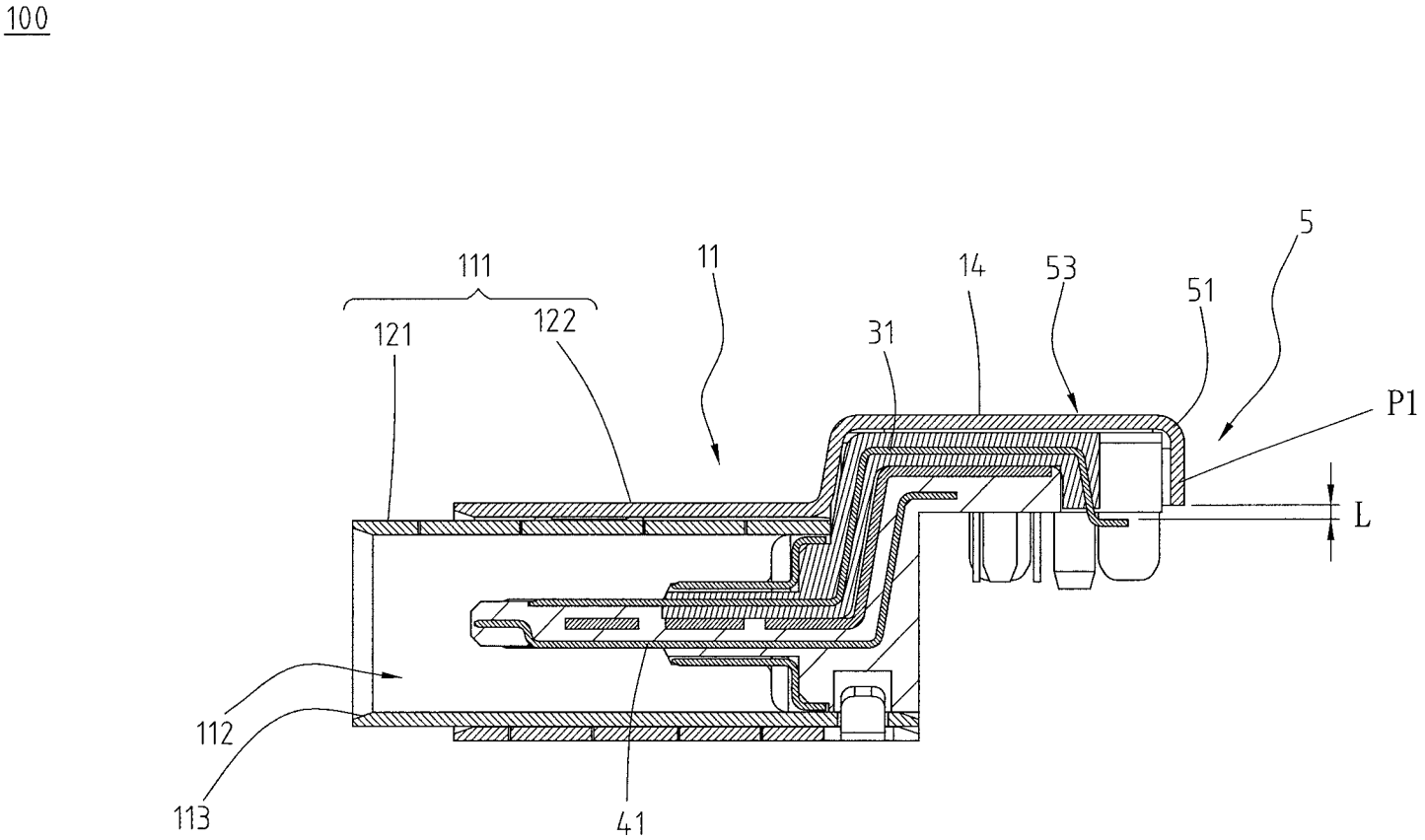
FIG. 5 illustrates a lateral sectional view of the electrical receptacle connector with the rear cover portion closed of the first embodiment.
Figure 6:
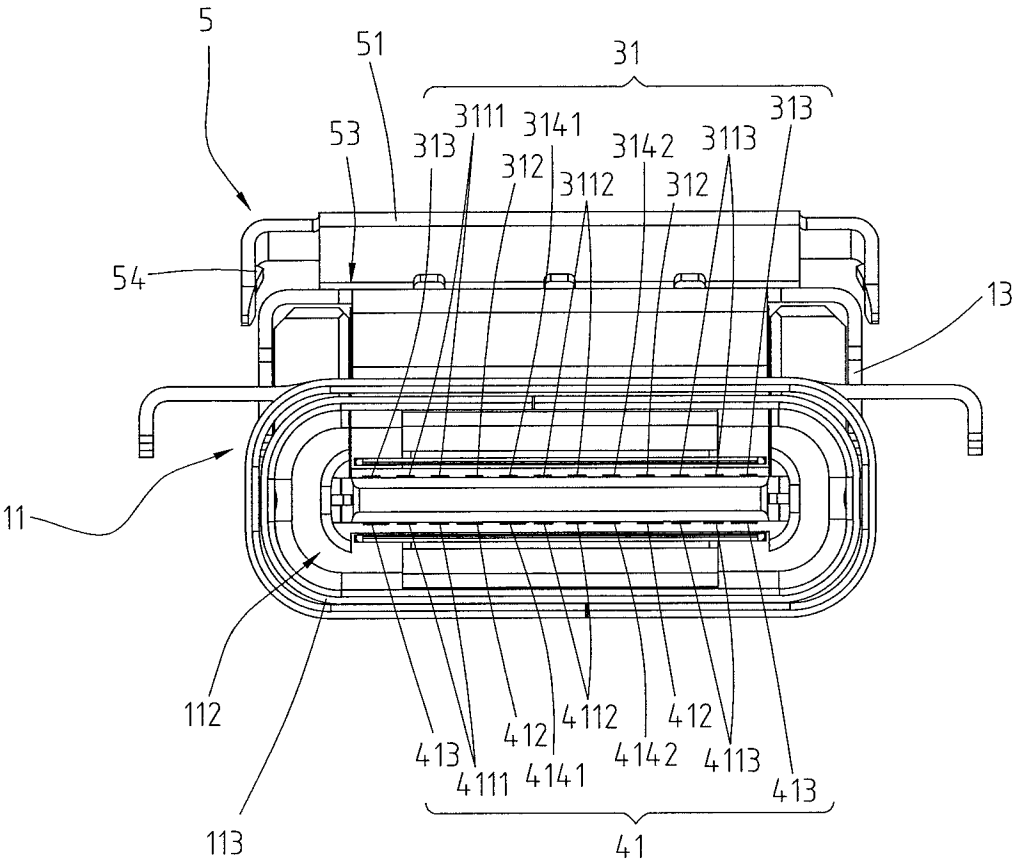
FIG. 6 illustrates a front sectional view of the electrical receptacle connector of the first embodiment.

Please refer to FIG. 5. When the rear cover portion 5 covers the rear of the metallic shell 11, the distance L between the tail portions 316 of the first receptacle terminals 31 and the surface of the other side of the baffle plate 51 (i.e., the surface of the bottom of the baffle plate 51) is less than or equal to 0.2 mm. Therefore, the electromagnetic radiation generated by the tail portions 316 of the first receptacle terminals 31 can be shielded by the rear cover portion 5 efficiently. In addition, the metallic shell 11 and the circuit board 8 are grounded, so that the electromagnetic interference (EMI) or radiofrequency interference (RFI) can be retarded properly.

Please refer to FIGS. 1, 2, 4, 5, and 8. In the case that the rear cover portion 5 and the metallic shell 11 are formed as a unitary member, the connecting portion 53 of the rear cover portion 5 comprises a plurality of bending portions 551, and the bending portions 551 are extending from the top of the baffle plate 51 toward the rear of the shell body 111 when the rear cover portion 5 is at the close position. The bending portions 551 are spaced from each other by holes h formed between the adjacent bending portions 551. Therefore, the structural strength of the connection between the rear cover portion 5 and the metallic shell 11 can be improved after the rear cover portion 5 are repeatedly opened and closed. Consequently, the rear cover portion 5 would not be detached from the metallic shell 11 easily.

Figure 8:
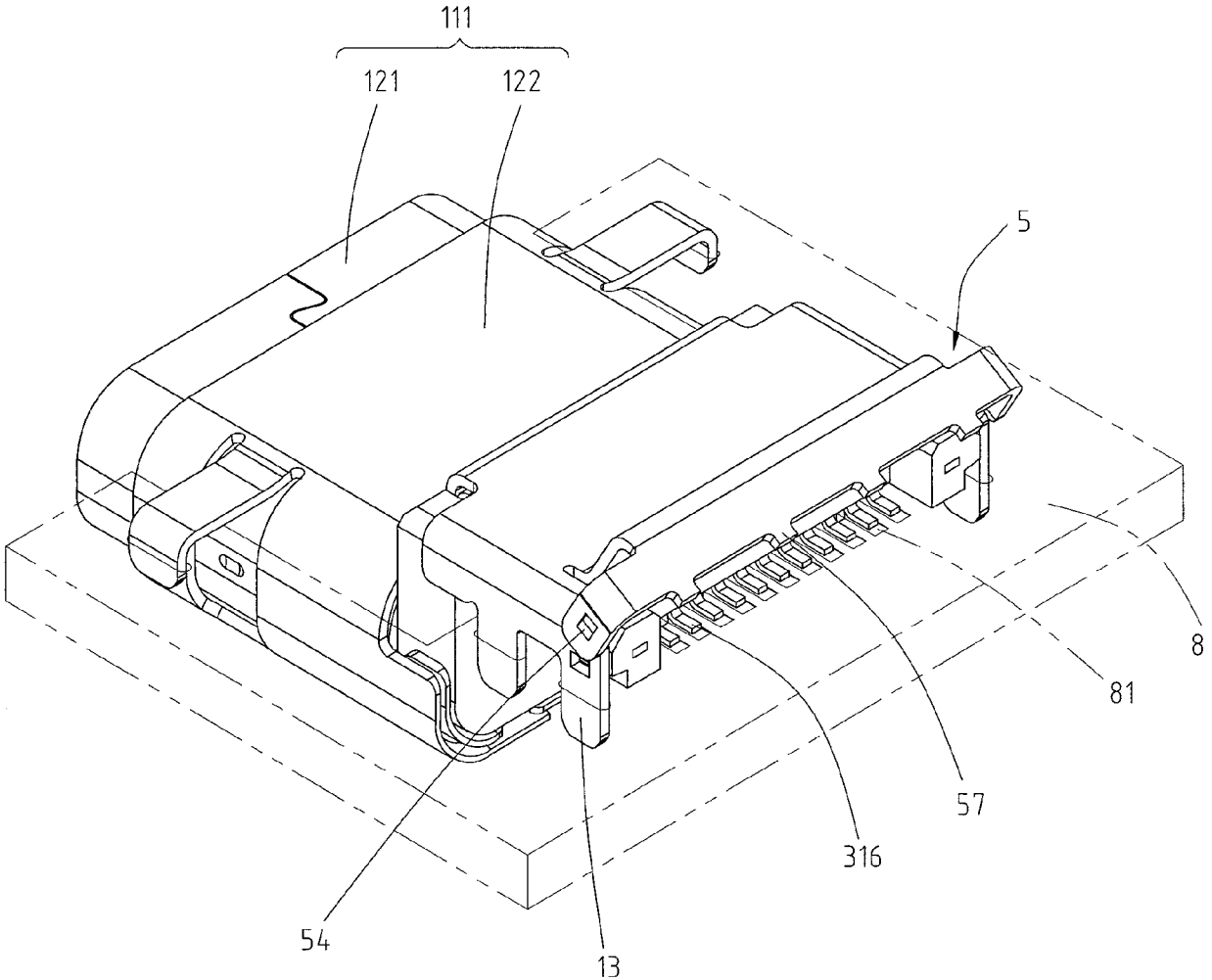
FIG. 8 illustrates a schematic view of the electrical receptacle connector with the rear cover portion opened according to the first embodiment, so that the soldering condition between the receptacle terminals and the contacts can be checked.

Please refer to FIGS. 4, 5 and 8. When the electrical receptacle connector 100 is soldered with a circuit board 8, the rear cover portion 5 is at an open position P2, where a user or an operator can check the soldering condition between the tail portions 316 of the first receptacle terminals 31 and the contacts 81 of the circuit board 8 from the opening at the rear of the connector when the rear cover portion 5 is at the open position P2. In other words, the fixing pieces 54 at two sides of the baffle plate 51 are not buckled with the lateral plates 13, so that the rear cover portion 5 can be opened freely. In addition, after the electrical receptacle connector 100 is soldered with the circuit board 8, the baffle plate 51 of the rear cover portion 5 can be rotated about the connecting portion 53, so that the baffle plate 51 is opened and uncovers the base portion 21. Therefore, when the rear cover portion 5 is at the open position P2, the baffle plate 51 is deflected upward and the position of the baffle plate 51 is higher than the top cover 14, the soldering condition between the tail portions 316 of the first receptacle terminals 31 and the contacts 81 of the circuit board 8 can be checked properly, and problems like soldering spots between adjacent contacts 81 are merged together or some of the tail portions 316 of the first receptacle terminals 31 are detached from the contacts 81 of the circuit board 8 may be solved. After the checking, the rear cover portion 5 is moved (i.e., rotated) to a closed position P1, the baffle 51 is deflected to a same level of the top cover 14, which means the rear cover portion 5 covers the rear of the base portion 21 and the fixing pieces 54 are respectively buckled with the lateral plates 13; thus the manufacturing of the connector can be achieved. In other words, the baffle plate 51 can be rotated about the connecting portion 53 to cover the base portion 21, so that the rear of the metallic shell 11 is shielded and covered. The openable and closeable rear cover portion 5 allows a user or an operator to check the soldering condition between the contacts 81 and the tail portions 316 of the first receptacle terminals 31 from the opening at the rear of the connector, and the soldering procedure can be redone when soldering spots are not applied to the contacts 81 and the tail portions 316 properly.

Figure 9:
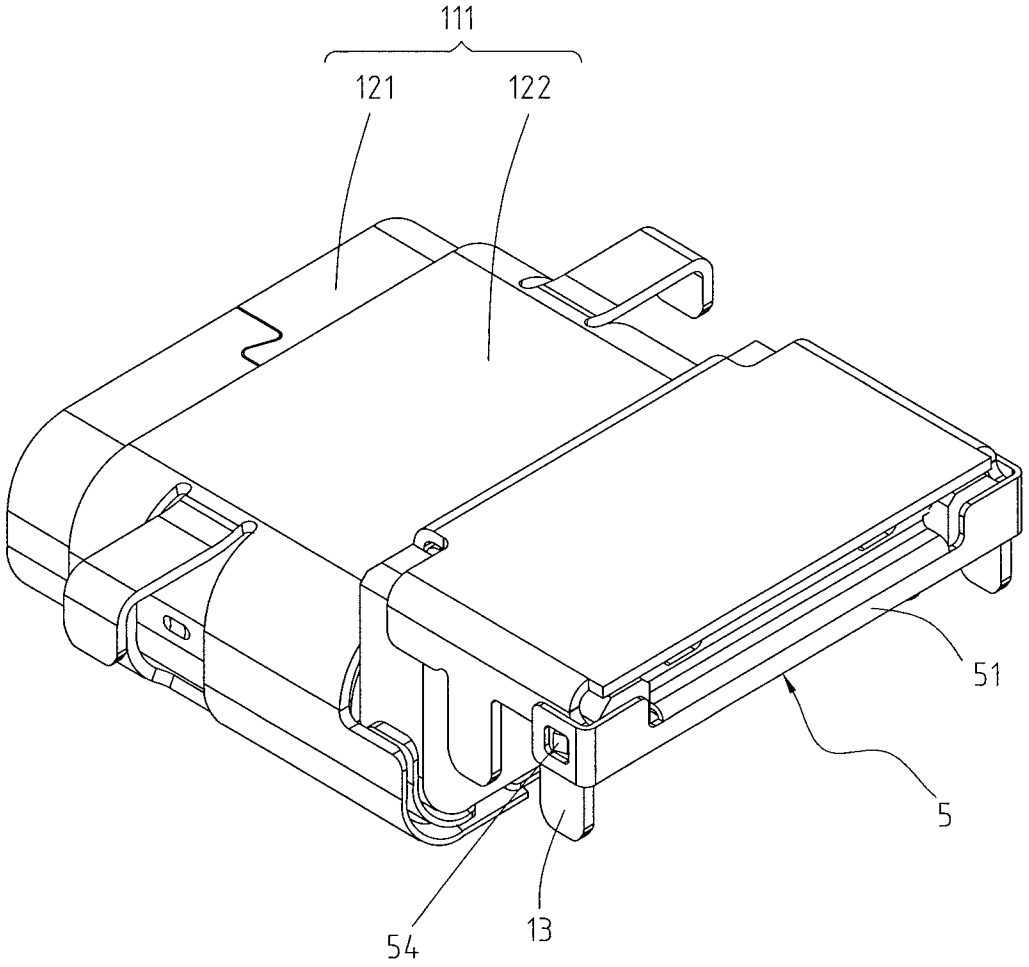
FIG. 9 illustrates a perspective view of an electrical receptacle connector according to a second embodiment of the instant disclosure.
Figure 10:
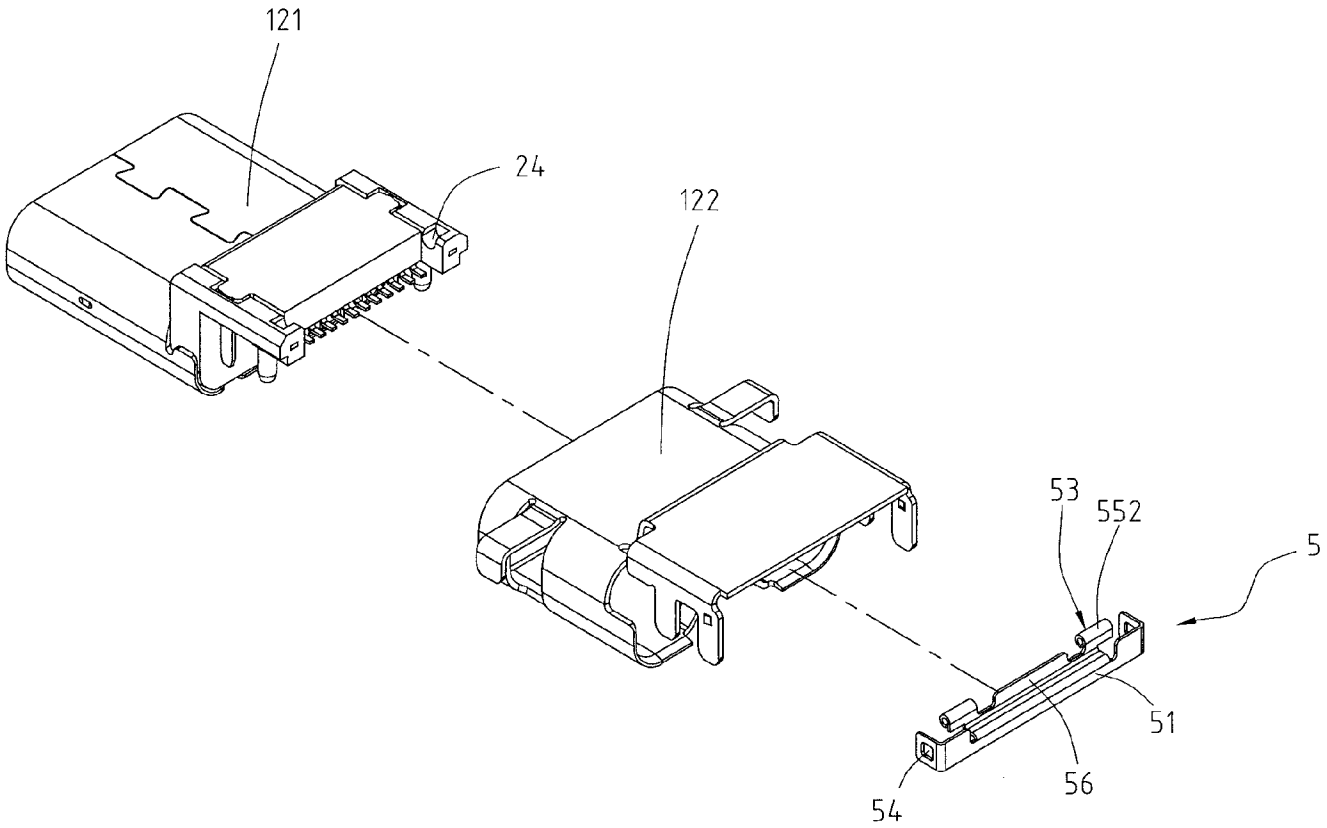
FIG. 10 illustrates an exploded view of the electrical receptacle connector of the second embodiment.
Figure 11:
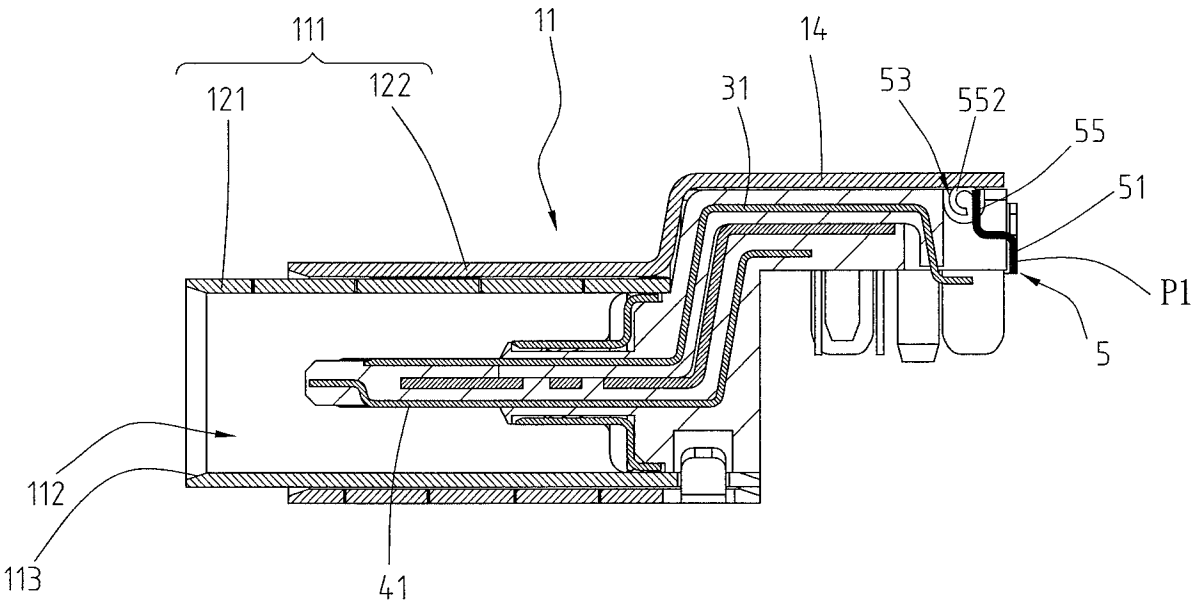
FIG. 11 illustrates a lateral sectional view of the electrical receptacle connector having the rear cover portion opened of the second embodiment.

Please refer to FIGS. 9 to 11, illustrating an electrical receptacle connector 100 according to a second embodiment of the instant disclosure. In the second embodiment, the rear cover portion 5 and the metallic shell 11 are separated pieces. In this embodiment, the connecting portion 53 comprises a plurality of hinges 552 extending from two sides of the top of the baffle plate 51 (as shown in FIG. 11). The hinge 552 is a hollowed cylinder. In addition, the insulated housing 2 may further comprise a plurality of recesses 24 formed on two sides of the top surface of the base portion 21. The hinges 552 are respectively received in the recesses 24, and the shell body 111 of the metallic shell 11 shields the recesses 24 to cover the hinges 552, so that the hinges 552 would not be detached from the recesses 24. Accordingly, the rear cover portion 5 with pivot structure can be easily opened or closed as compared with the first embodiment. In the first embodiment, because the rear cover portion 5 and the metallic shell 11 are formed integrally, a force with certain magnitude has to be provided to open or to close the rear cover portion 5. In the second embodiment, because the rear cover portion 5 and the metallic shell 11 are separated pieces and connected with each other via the pivot structure, so that the rear cover portion 5 can be opened or closed easily.

In addition, in some embodiments, the rear cover portion 5 further comprises a stopping plate 56 extending from the top of the baffle plate 51. In other words, the top of the L-shaped baffle plate 51 further extends the stopping plate 56. The baffle plate 51 and the stopping plate 56 together form a laid and reversed Z shape structure. In addition, the stopping plate 56 is between two hinges 552. When the rear cover portion 5 is at the open position P2, that is, when the baffle plate 51 and the shell body 111 of the metallic shell 11 are parallel with each other, the stopping plate 56 may be leaned against the inner surface of the shell body 111 of the metallic shell 11, so that the angle between the rear cover portion 5 and the metallic shell 11 can be maintained properly.

Please refer to FIGS. 2 to 4. In some embodiments, the electrical receptacle connector 100 further comprises a grounding plate 7 at the insulated housing 2. The grounding plate 7 comprises a plate body 71 and a plurality of legs 72. The plate body 71 is between the flat contact portions 315 of the first receptacle terminals 31 and the flat contact portions 415 of the second receptacle terminals 41. In other words, the plate body 71 is held in the base portion 21 and the tongue portion 22 and between the flat contact portions 315, 415. In addition, the legs 72 are respectively extending downward from two sides of the plate body 71 and extending out of the bottom of the base portion 21. The legs 72 are in contact with the contacts 81 of the circuit board 8. Moreover, the legs 72 may be extending backward from the two sides of the plate body 71 toward the rear of the base portion 21, and the legs 72 are in contact with the rear cover portion 5. The crosstalk interference can be reduced by the shielding of the grounding plate 7 when the flat contact portions 315, 415 transmit signals. Furthermore, the structural strength of the tongue portion 22 can be improved by the assembly of the grounding plate 7. Moreover, the legs 72 extending downward from the two sides of the plate body 71 may be provided as through-hole legs, and the legs 72 are exposed from the base portion 21 to be in contact with the circuit board 8. Furthermore, the grounding plate 7 comprises a plurality of hooks 73 protruded from two sides of the tongue portion 22. When an electrical plug connector is mated with the electrical receptacle connector 100, elastic pieces at two sides of an insulated housing of the electrical plug are engaged with the hooks 73, and the elastic pieces would not wear against the tongue portion 22 of the electrical receptacle connector 100. Additionally, the electrical plug connector may further comprise a plurality of protruded abutting portions, and the protruded abutting portions are in contact with the metallic shell 11 of the electrical receptacle connector 100. Hence, the elastic pieces and the protruded abutting portions are provided for conduction and grounding.

Please refer to FIGS. 2 to 4. In this embodiment, the electrical receptacle connector 100 further comprises a plurality of conductive sheets. The conductive sheets are metal elongated plates and may comprise an upper conductive sheet and a lower conductive sheet. The upper conductive sheet is assembled on the upper portion of the base portion 21, and the lower conductive sheet is assembled on the lower portion of the base portion 21. When an electrical plug connector is mated with the electrical receptacle connector 100, the front of a metallic shell of the electrical plug connector is in contact with the conductive sheets, the metallic shell of the electrical plug connector is efficiently in contact with the metallic shell 11 of the electrical receptacle connector 100 via the conductive sheets, and the electromagnetic interference problem can be improved.

According to embodiments of the instant disclosure, the openable and closeable rear cover portion allows a user or an operator to check the soldering condition between the contacts and the tail portions of the first receptacle terminals from the opening at the rear of the connector, and the soldering procedure can be redone when soldering spots are not applied to the contacts and the tail portions properly. After the contacts are firmly soldered with the tail portions of the first receptacle terminals, the rear cover portion can be covered on the rear of the receiving cavity, and the connector can be manufactured. In addition, the rear cover portion may be pivoted about the rear of the metallic shell closed, so that the rear cover opening can be opened or closed conveniently.

Furthermore, the rear cover portion further comprises a plurality of protruded blocks. When the rear cover portion covers the rear of the metallic shell, the protruded blocks may be leaned against the surface of the circuit board. Therefore, the rear cover portion can be opened again because the protruded blocks are not soldered with the circuit board; Alternatively, when the rear cover portion covers the rear of the metallic shell, the protruded blocks may be respectively in contact with and soldered with contacts of the circuit board, which means is allowed to be opened and closed one time.

Moreover, When the rear cover portion covers the rear of the metallic shell, the distance between the tail portions of the first receptacle terminals and the surface of the other side of the baffle plate (i.e., the surface of the bottom of the baffle plate is less than or equal to 0.2 mm. Therefore, the electromagnetic radiation generated by the tail portions of the first receptacle terminals can be shielded by the rear cover portion efficiently. In addition, the metallic shell and the circuit board are grounded, so that the electromagnetic interference (EMI) or radiofrequency interference (RFI) can be retarded properly. In other words, the covering of the rear cover portion allows the exposed area of the tail portions of the first receptacle terminals to be reduced, and the rear cover portion can provide a shielding function and prevent the connector from the signal interference problem.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

The invention claimed is:

1. An electrical receptacle connector, comprising:

a metallic shell, comprising a shell body and a receiving cavity formed in the shell body, wherein the shell body comprises a case and a top cover, the top cover is bent and extending upward from the rear of the case;

an insulated housing received in the receiving cavity, wherein the insulated housing comprises a base portion, a tongue portion, a rear body and a soldering region, wherein the tongue is extending from one side of the base portion, the tongue portion has a first surface and a second surface, and the first surface is opposite to the second surface, the rear body is bent and extending upward from the rear of the base portion, the soldering region is defined at the bottom of the rear body, and the rear body is covered by the top cover;

a plurality of first receptacle terminals, wherein each of the first receptacle terminals is held in the insulated housing and disposed at the first surface, wherein each of the first receptacle terminals comprises a flat contact portion, a body portion, and a tail portion, wherein the body portion is held in the base portion and disposed at the first surface of the tongue portion, the flat contact portion is extending forward from the body portion in the rear-to-front direction and partly exposed upon the first surface of the tongue portion, the tail portion is extending backward from the body portion in the front-to-rear direction and extending out of the base portion;

a plurality of second receptacle terminals, wherein each of the second receptacle terminals is held in the insulated housing and disposed at the second surface, wherein each of the second receptacle terminals comprises a flat contact portion, a body portion, and a tail portion, wherein the body portion is held in the base portion and disposed at the second surface of the tongue portion, the flat contact portion is extending forward from the body portion in the rear-to-front direction and partly exposed upon the second surface of the tongue portion, the tail portion is extending backward from the body portion in the front-to-rear direction and extending out of the base portion; and a rear cover portion at the rear of the top cover, wherein the rear cover portion comprises a baffle plate and a connecting portion formed at one of two sides of the baffle plate, and wherein when the rear cover portion is at an open position, the baffle plate is rotated about the connecting portion and deflected upward to uncover the base portion, and the position of the baffle plate is higher than the top cover, while when the rear cover is at a closed position, the baffle plate is rotated about the connecting portion, and deflected to a same level of the top cover to cover the base portion.

2. The electrical receptacle connector according to claim 1, wherein the rear cover portion further comprises a plurality of fixing pieces at two sides of the baffle plate, and wherein the metallic shell comprises a plurality of lateral plates at two sides of the shell body, the fixing pieces are respectively buckled with the lateral plates and the rear cover portion is at the closed position.

3. The electrical receptacle connector according to claim 1, wherein the connecting portion comprises a bending portion extending from the top of the baffle plate toward the rear of the shell body when the rear cover portion is at the close position.

4. The electrical receptacle connector according to claim 1, wherein the connecting portion comprises a plurality of hinges extending from two sides of the top of the baffle plate, and wherein the insulated housing further comprises a plurality of recesses formed on the base portion, the hinges are respectively received in the recesses, and the shell body of the metallic shell shields the recesses.

5. The electrical receptacle connector according to claim 4, wherein the rear cover portion further comprise a stopping plate extending from the top of the baffle plate, and wherein when the rear cover portion is at the open position, the stopping plate is leaned against the inner surface of the shell body of the metallic shell.

6. The electrical receptacle connector according to claim 1, wherein the rear cover portion further comprises a plurality of protruded blocks, and the protruded blocks are extending outward from the other side of the baffle plate and spaced from each other.

7. The electrical receptacle connector according to claim 1, further comprising a grounding plate at the insulated housing and between the first receptacle terminals and the second receptacle terminals.

8. The electrical receptacle connector according to claim 1, wherein the position of the first receptacle terminals corresponds to the position of the second receptacle terminals.

9. The electrical receptacle connector according to claim 1, wherein the plurality of first receptacle terminals comprises a plurality of first signal terminals, at least one power terminal, and at least one ground terminal and the plurality of second receptacle terminals comprises a plurality of second signal terminals, at least one power terminal, and at least one ground terminal.

10. An electrical receptacle connector, comprising:

a metallic shell, comprising a shell body and a receiving cavity formed in the shell body;

an insulated housing received in the receiving cavity, wherein the insulated housing comprises a base portion, a tongue portion extending from one side of the base portion, and a plurality of recesses formed on the base portion, the tongue portion has a first surface and a second surface, and the first surface is opposite to the second surface;

a plurality of first receptacle terminals, wherein each of the first receptacle terminals is held in the insulated housing and disposed at the first surface, wherein each of the first receptacle terminals comprises a flat contact portion, a body portion, and a tail portion, wherein the body portion is held in the base portion and disposed at the first surface of the tongue portion, the flat contact portion is extending forward from the body portion in the rear-to-front direction and partly exposed upon the first surface of the tongue portion, the tail portion is extending backward from the body portion in the front-to-rear direction and extending out of the base portion;

a plurality of second receptacle terminals, wherein each of the second receptacle terminals is held in the insulated housing and disposed at the second surface, wherein each of the second receptacle terminals comprises a flat contact portion, a body portion, and a tail portion, wherein the body portion is held in the base portion and disposed at the second surface of the tongue portion, the flat contact portion is extending forward from the body portion in the rear-to-front direction and partly exposed upon the second surface of the tongue portion, the tail portion is extending backward from the body portion in the front-to-rear direction and extending out of the base portion; and a rear cover portion at the rear of the metallic shell, wherein the rear cover portion comprises a baffle plate, a connecting portion formed at one of two sides of the baffle plate and a plurality of hinges extending from two sides of the top of the baffle plate, and a stopping plate extending from the top of the baffle plate, and between the hinges wherein the hinges are respectively received in the recesses, the shell body of the metallic shell shields the recesses, and wherein when the rear cover portion is at an open position, the baffle plate is rotated about the connecting portion to uncover the base portion, and the stopping plate is leaned against the inner surface of the shell body of the metallic shell, while when the rear cover is at a closed position, the baffle plate is rotated about the connecting portion to cover the base portion.

* * * * *